US005680991A

United States Patent [19]

Truitt

[11] Patent Number: 5,680,991

[45] Date of Patent: Oct. 28, 1997

[54] AIR DISTRIBUTION SYSTEM AND SPRAYER INCORPORATING AN AIR DISTRIBUTION SYSTEM

[76] Inventor: Archie Arthur Truitt, 119 - 33 Street West, Saskatoon, Saskatchewan S7L 0T9, Canada

[21] Appl. No.: 507,888

[22] Filed: Jul. 27, 1995

Related U.S. Application Data

[63] Continuation-in-part of Ser. No. 246,457, May 20, 1994, Pat. No. 5,468,185, which is a continuation-in-part of Ser. No. 115,630, Sep. 3, 1993, abandoned, which is a continuation-in-part of Ser. No. 921,145, Jul. 29, 1992, Pat. No. 5,277,657.

[51] Int. Cl.[6] ..... B05B 1/28

[52] U.S. Cl. ..... 239/290; 239/568; 239/590

[58] Field of Search ..... 239/553, 568, 239/597, 450, 290, 296, 299

[56] References Cited

U.S. PATENT DOCUMENTS

| | | | |
|---|---|---|---|
| 408,235 | 8/1889 | Haskell | 234/553.5 |
| 587,373 | 8/1897 | Parker et al. | 454/198 |
| 791,924 | 6/1905 | Magee | 454/198 |
| 1,717,904 | 6/1929 | Abernethy | 454/93 |
| 2,799,902 | 7/1957 | Muller | 454/127 |
| 2,836,932 | 6/1958 | Potter . | |
| 2,949,239 | 8/1960 | Goyette | 239/568 X |
| 3,409,233 | 11/1968 | Kiernan | 239/597 X |
| 3,472,454 | 10/1969 | Blue et al. . | |
| 3,729,735 | 4/1973 | Dageford | 236/112 |
| 3,741,643 | 6/1973 | Smith et al. | 239/597 X |
| 3,744,724 | 7/1973 | Caille | 454/198 |
| 3,804,332 | 4/1974 | Welch . | |
| 4,274,589 | 6/1981 | Jones . | |
| 4,537,116 | 8/1985 | Nassof | 454/188 |
| 4,583,319 | 4/1986 | Wolff et al. . | |
| 4,916,216 | 4/1990 | Crear, III et al. . | |
| 4,927,080 | 5/1990 | Alsing . | |
| 4,982,898 | 1/1991 | Ballu . | |
| 5,012,980 | 5/1991 | Viannay et al. | 239/543 |
| 5,098,018 | 3/1992 | Hadar et al. . | |
| 5,277,657 | 1/1994 | Truitt . | |

FOREIGN PATENT DOCUMENTS

| | | | |
|---|---|---|---|
| 14546/83 | 12/1983 | Australia . | |
| 0272740 | 12/1987 | European Pat. Off. . | |
| 0543217 | 11/1992 | European Pat. Off. . | |
| 1564543 | 1/1968 | France . | |
| 883523 | 7/1953 | Germany | 454/198 |
| 4110127 | 10/1992 | Germany | 239/568 |
| 700624 | 11/1979 | U.S.S.R. | 239/290 |
| WO86/04272 | 7/1986 | WIPO . | |
| WO86/05173 | 9/1986 | WIPO . | |
| WO88/01539 | 3/1988 | WIPO . | |
| WO89/10203 | 11/1989 | WIPO . | |
| WO92/17280 | 10/1992 | WIPO . | |
| WO95/16347 | 6/1995 | WIPO . | |

OTHER PUBLICATIONS

Hardi International A/S Brochure (undated).

*Primary Examiner*—Kevin Weldon
*Attorney, Agent, or Firm*—Bereskin & Parr

[57] ABSTRACT

A spray apparatus has first and second elongate ducts. The material to be sprayed, which may be solid or liquid, is delivered through the first elongate duct to an elongate slot-shaped nozzle or other means for distributing it. To reduce disturbance by de-energizing ambient air currents, the second elongate duct supplies air to first and second air distribution outlets, each of which defines an elongate slot-shaped nozzle. The nozzle is directed outwardly, away from the air distribution mechanism and towards the surface on which the material is to be distributed, so as to form air curtains on either side of the elongate ducts. The elongate air distribution outlet can form an elongate slot-shaped nozzle having a convergent inlet section, a throat section and a diffuser section extending to an outlet port. It can also include fins extending into the air duct, to deflect air from the air duct through the slot-shape nozzle.

34 Claims, 8 Drawing Sheets

AIR DISTRIBUTION SYSTEM AND SPRAYER INCORPORATING AN AIR DISTRIBUTION SYSTEM

CROSS-REFERENCE TO RELATED APPLICATIONS

This application is a Continuation-in-Part of my earlier application Ser. No. 08/246,457 filed May 20, 1994, now U.S. Pat. No. 5,468,185 which in turn is a Continuation-in-Part of my earlier application Ser. No. 08/115,630 filed Sep. 3, 1993, now abandoned, which in turn is a Continuation-in-Part of my earlier application Ser. No. 07/921,145 filed Jul. 29, 1992, now U.S. Pat. No. 5,277,657.

FIELD OF THE INVENTION

This invention relates to an air distribution system, and in particular to an air distribution system for providing a continuous air current. It also relates to a spraying system incorporating such an air distribution system.

BACKGROUND OF THE INVENTION

My earlier U.S. application Ser. No. 08/246,457 and earlier U.S. Pat. No. 5,277,657, the contents of which are hereby incorporated by reference, disclose different air distribution system concepts. The initial problem to which these earlier inventions were directed was that of condensation collection on exterior windows. This can occur in buildings, automobiles, buses or aircraft. Condensation is unsightly, reduces light available, and in vehicles, can obscure the driver's line of sight, which can be dangerous. Build up of condensation around the base of windows can result in corrosion, rotting of wooden structures, growth of fungi and the like.

Accordingly, the proposals in my earlier application and patent focused on air distribution duct configured for use up against a window or the like. Generally, the preferred embodiments described in my earlier applications included a rectangular section duct. A distribution divider divided the duct to define inlet and outlet portions, and a communication passage extended longitudinally of the duct for air communication between the inlet and outlet portions. The passage increased in width with increasing distance from an inlet port and included a plurality of fins extending into the inlet portion. The configuration was such that a uniform air flow was provided along the length of the air distribution duct. The actual outlet port was provided adjacent one side, for use up against a window, etc.

Those earlier applications did not detail or suggest other applications of the air distribution duct. Further, the fin configuration proposed in those earlier applications, while providing for even air distribution, was not the most efficient. Additionally, the overall length of the duct was not great, in view of the intended application. At that time, it had not been developed in lengths longer than 48 inches.

SUMMARY OF THE PRESENT INVENTION

Accordingly, it is desirable to provide an air distribution system which can provide a continuous curtain of air over a considerable distance and which is efficient, so as to minimise power requirements. It is also desirable to provide an air curtain for sprayers and like apparatus for distributing material, to reduce or eliminate drift of the material, for example a chemical to be sprayed on crops.

It is also desirable to provide an air distribution system, which can be used for other purposes and which can provide ducts of substantial length for industrial applications and the like.

In accordance with a first embodiment of the present invention, there is provided an apparatus for distributing a particulate material over a surface, the apparatus comprising:

a first elongate duct means for delivery of material to be distributed, including an inlet for the particulate material, the duct being intended for movement in a direction generally perpendicular thereto with the duct being maintained at a generally constant spacing from the surface;

distribution means for distributing the particulate material, the distribution means extending along the first elongate duct means and being connected to the first elongate duct means; and air curtain means extending along the first elongate duct means and including an at least one elongate air distribution outlet, and means for supplying air to said air distribution outlet, to form an air curtain to reduce disturbance by ambient air currents of material distributed by the distribution means wherein said elongate air distribution outlet is positioned relative to the distribution means such that there is substantially no interaction between the air curtain and particulate material distributed from the distribution means.

Preferably, the air curtain means comprises a first elongate air distribution outlet in front of the first elongate duct means and a second elongate air distribution outlet behind the first elongate duct means. Even more preferably, the air curtain means includes: a second elongate duct means for a supply of air, mounted adjacent the first elongate duct means and including an inlet for air, wherein each of the first and second air distribution outlets includes an elongate, substantially continuous slot-shaped nozzle extending therealong, which nozzles include inlet ports opening into the second elongate duct means and outlet ports directed outwardly from the first elongate duct means and towards a surface on which the material is to be dispersed.

In order, to form a substantially continuous air curtain around the distribution means, the air curtain means advantageously includes end distribution outlets extending between ends of the first and second air distribution outlets.

Preferably, each of the first and second air distribution outlets includes a convergent inlet section, a throat section and a diffuser section, wherein the width of the respective throat section increases in a direction away from the inlet of the second duct means, and each outlet preferably also includes a plurality of fins spaced therealong, each of which fins includes one end directed towards the inlet of the second elongate duct means and another end directed towards the outlet port, to direct air from the second elongate duct through the elongate slot-shaped nozzle.

In accordance with another aspect of the present invention, there is provided an air distribution outlet comprising: an elongate air duct having an inlet for air; an elongate air distribution outlet mounted on and extending along the elongate air duct and defining an elongate slot-shaped nozzle, which has an inlet port opening into the air duct and an outlet port; wherein the nozzle has extending between the inlet port and the outlet port thereof, a convergent inlet section, a throat section, and a diffuser section, wherein the width of the throat section increases in a direction away from the air inlet.

Preferably, in section, the convergent, throat and diffuser sections are coaxial and the nozzle in cross-section has a common axis, and the diffuser section has surfaces defining the diffuser section, which are at an angle of no more than 6° to the axis of the nozzle.

BRIEF DESCRIPTION OF THE DRAWING FIGURES

For a better understanding of the present invention and to show more clearly how it may be carried into effect, reference will now be made, by way of example, to the accompanying drawings, which show a preferred embodiment of the present invention and in which.

Figure 3:
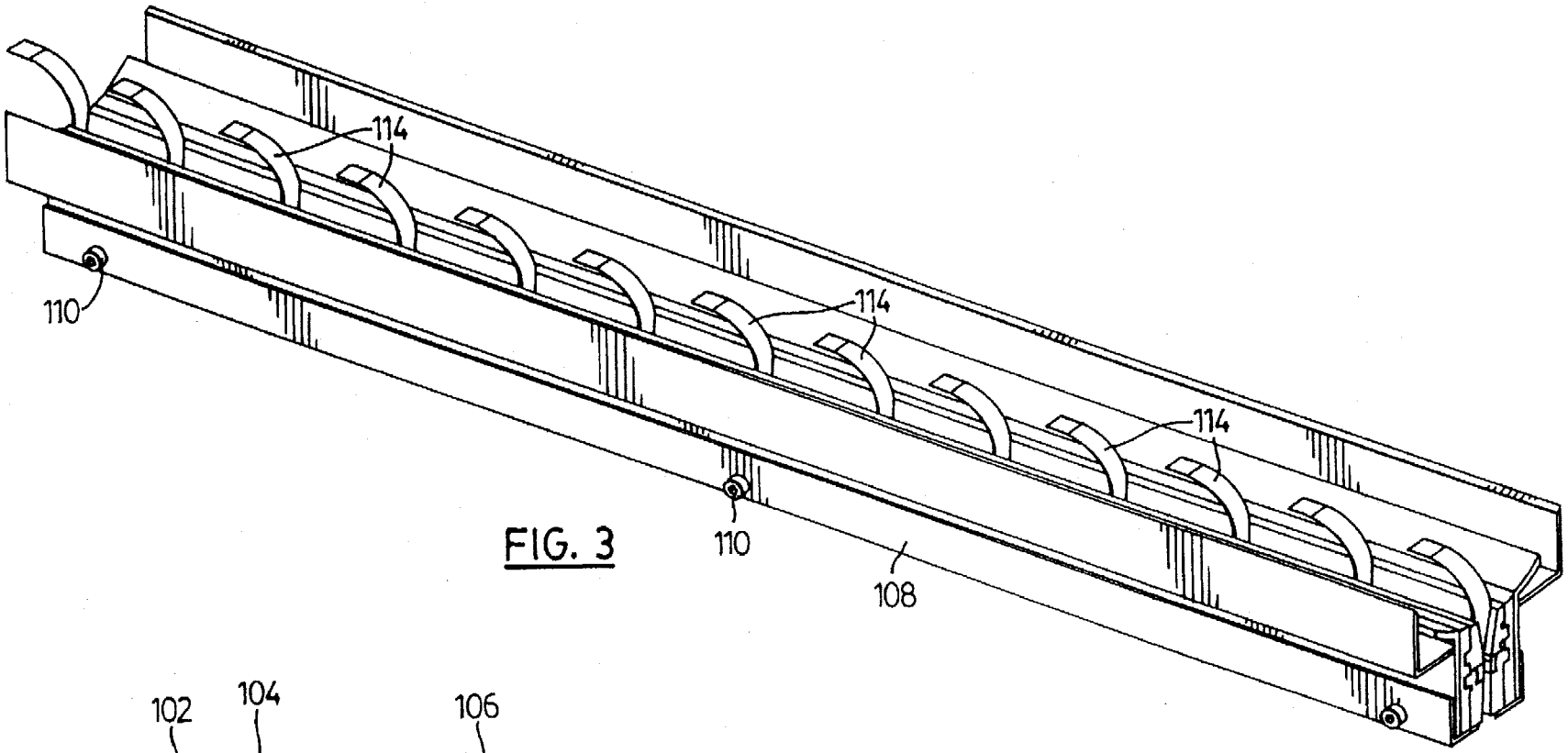
FIG. 3 is an isometric view of one distribution system section of the apparatus of FIGS. 1 and 2.
Figure 5:
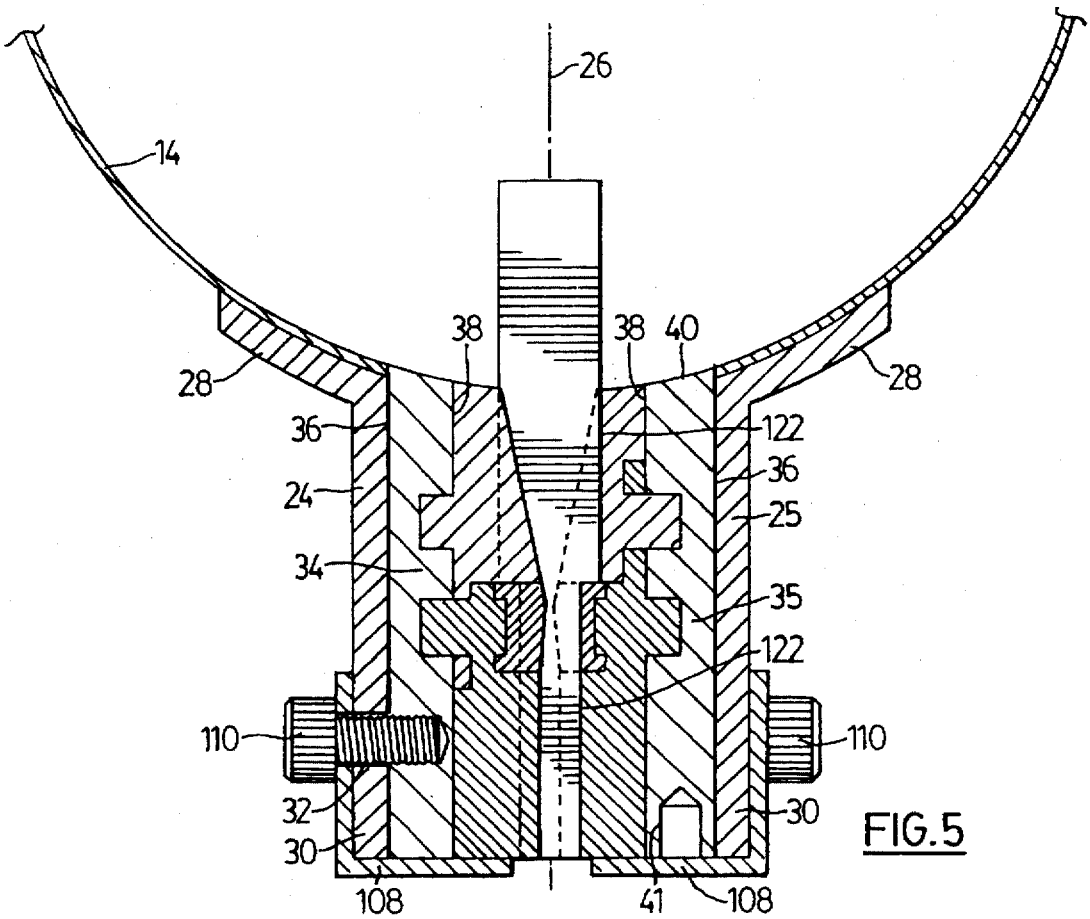
Figure 8:
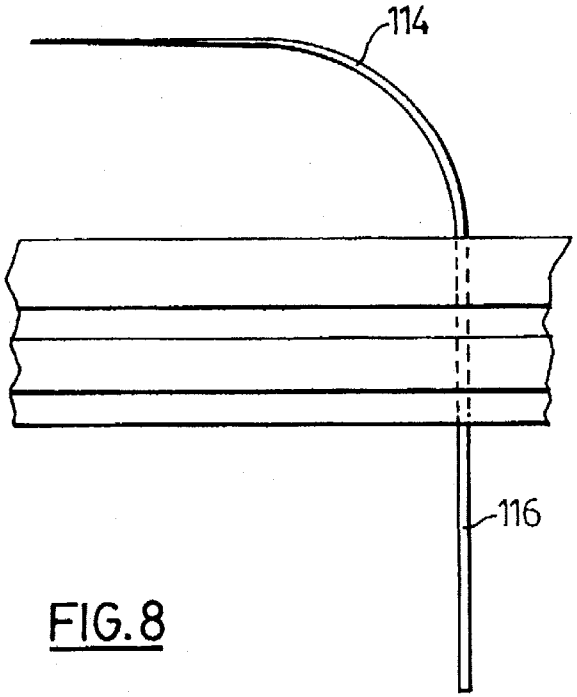
Figure 7:
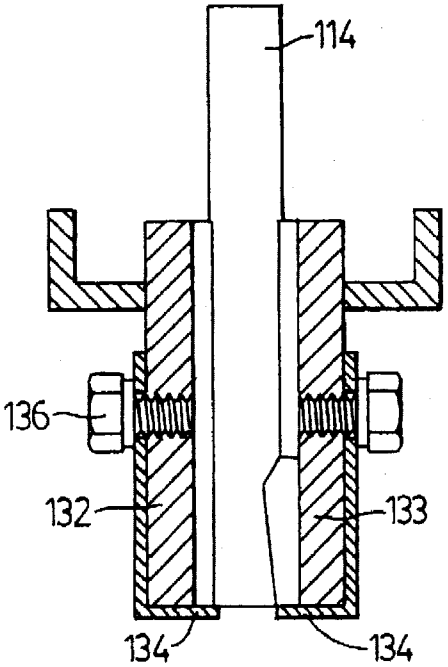
Figure 6:
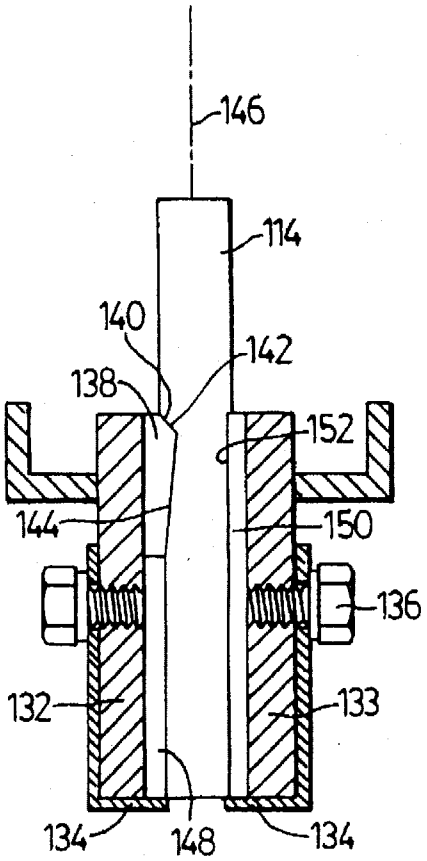
Figure 11:
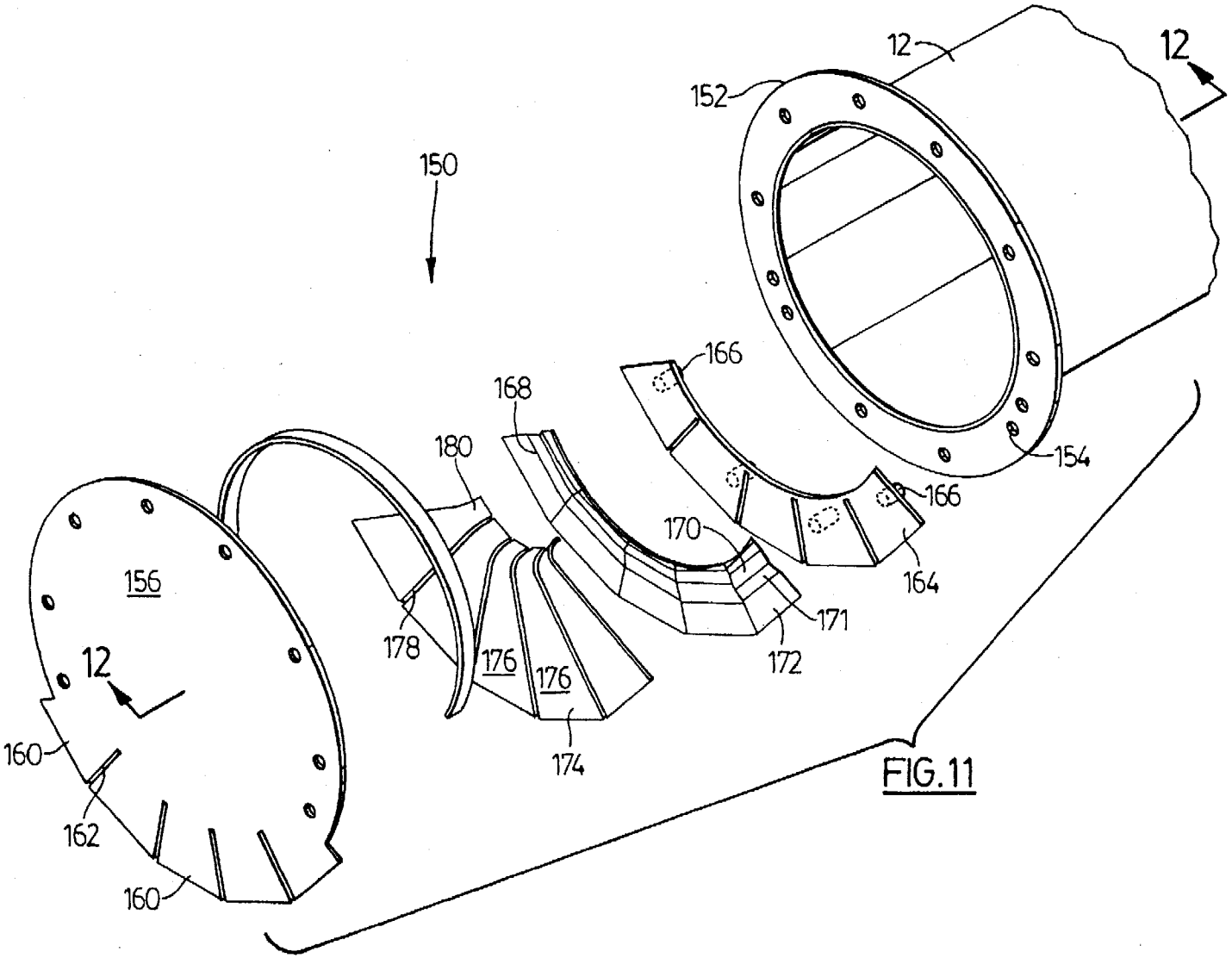
Figure 9:
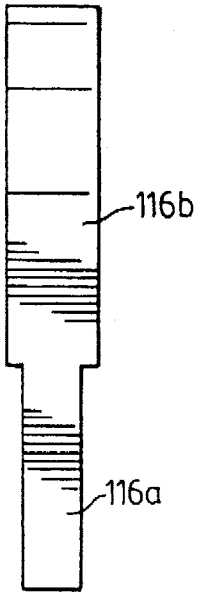
Figure 10:
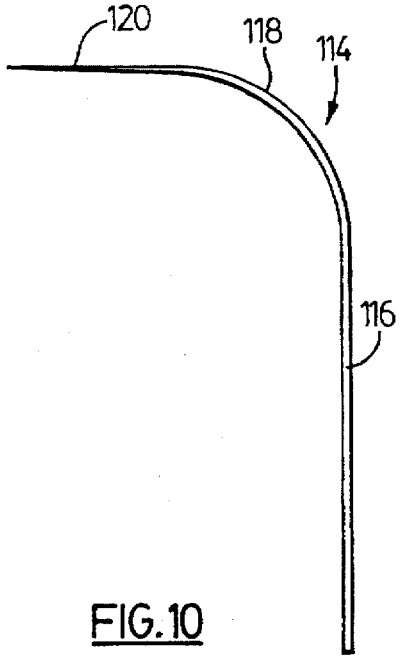

FIGS. 4*a*, 4*b*, 4*c*, 4*d* and 4*e* are sectional view through the inlet, outlet and throat members of the distribution section of FIG. 3;

FIG. 5 is a vertical cross-section through a spray duct, the section on one side being such as to show one side of a fin;

FIGS. 6 and 7 show cross-sections through different air distribution outlet configurations;

FIG. 8 is a side view of a fin assembly, showing one fin fitted into an inlet member;

FIGS. 9 and 10 show details of an individual fin;

FIG. 11 shows a perspective, exploded view of an end distribution outlet; and

Figure 12:
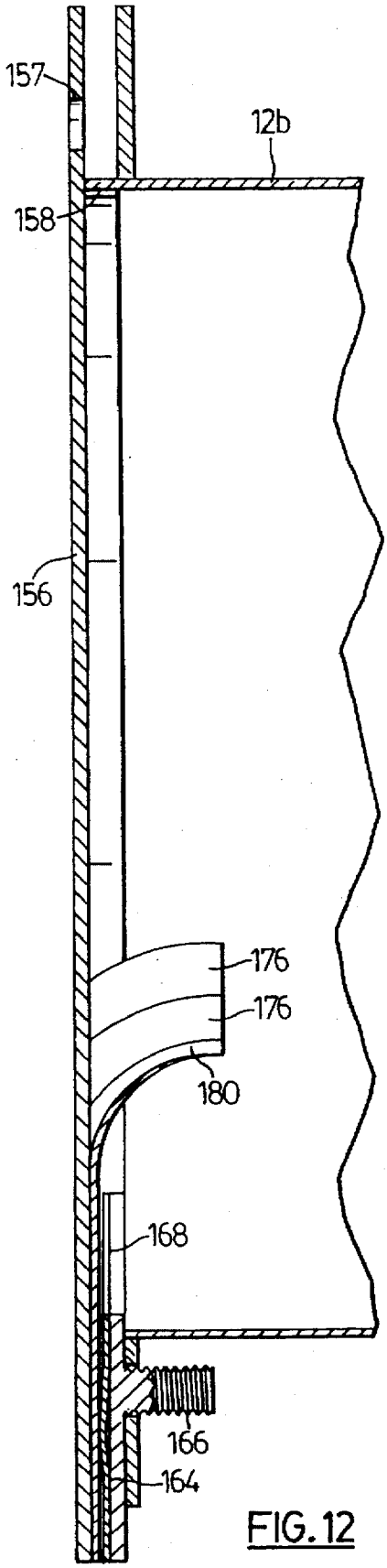
Figure 12A:
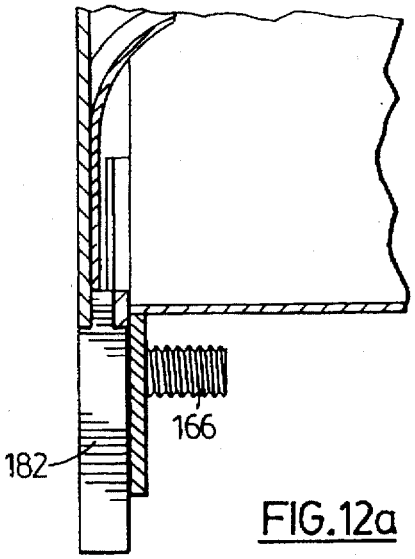

FIGS. 12*a* and 12 show cross sectional views through the end outlet of FIG. 11, taken generally along line 12—12 of FIG. 11.

DESCRIPTION OF PREFERRED EMBODIMENT

Figure 1:
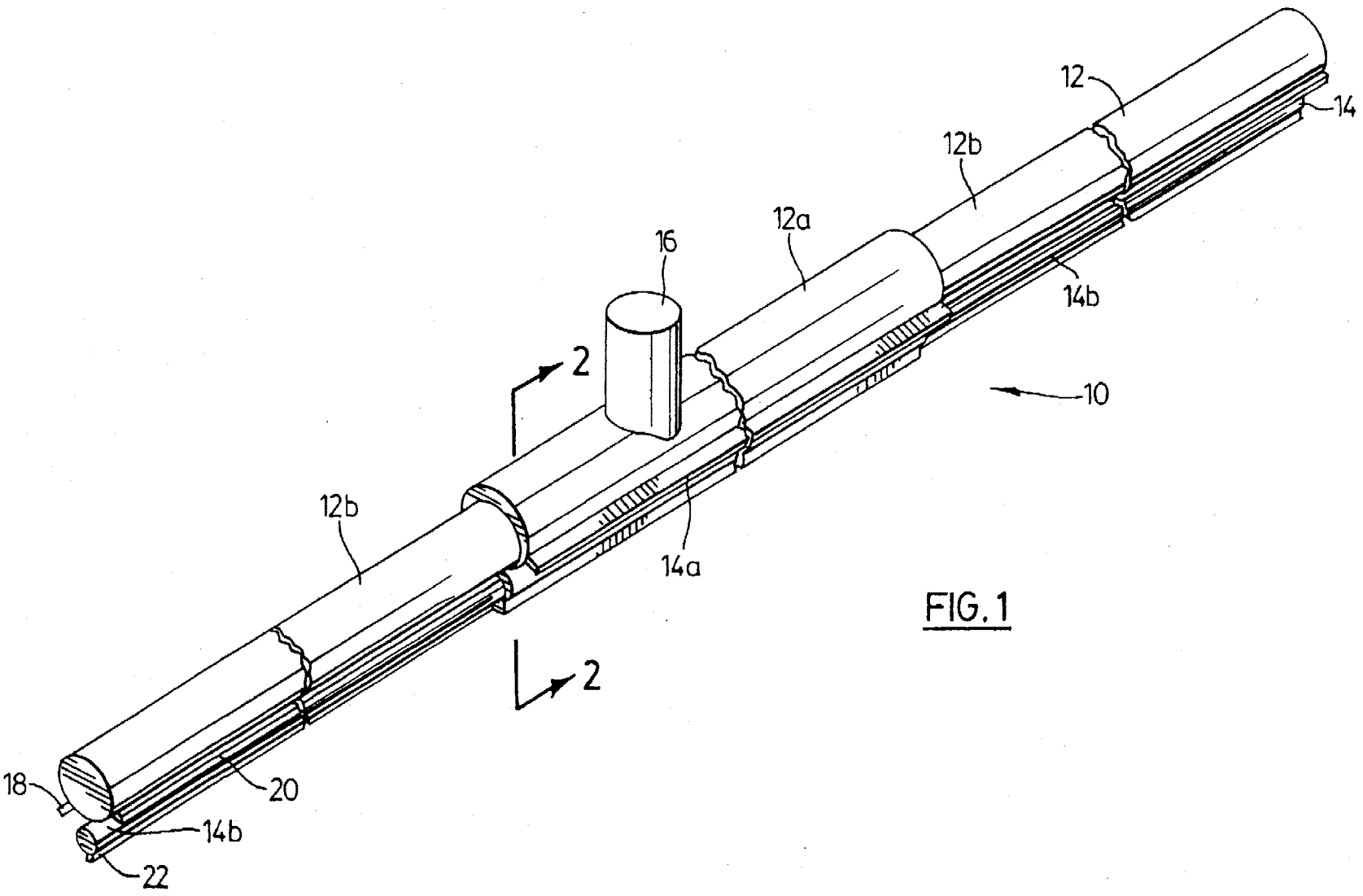
FIG. 1 shows a perspective view of an apparatus for distributing material over a surface in accordance with the present invention.
Figure 2:
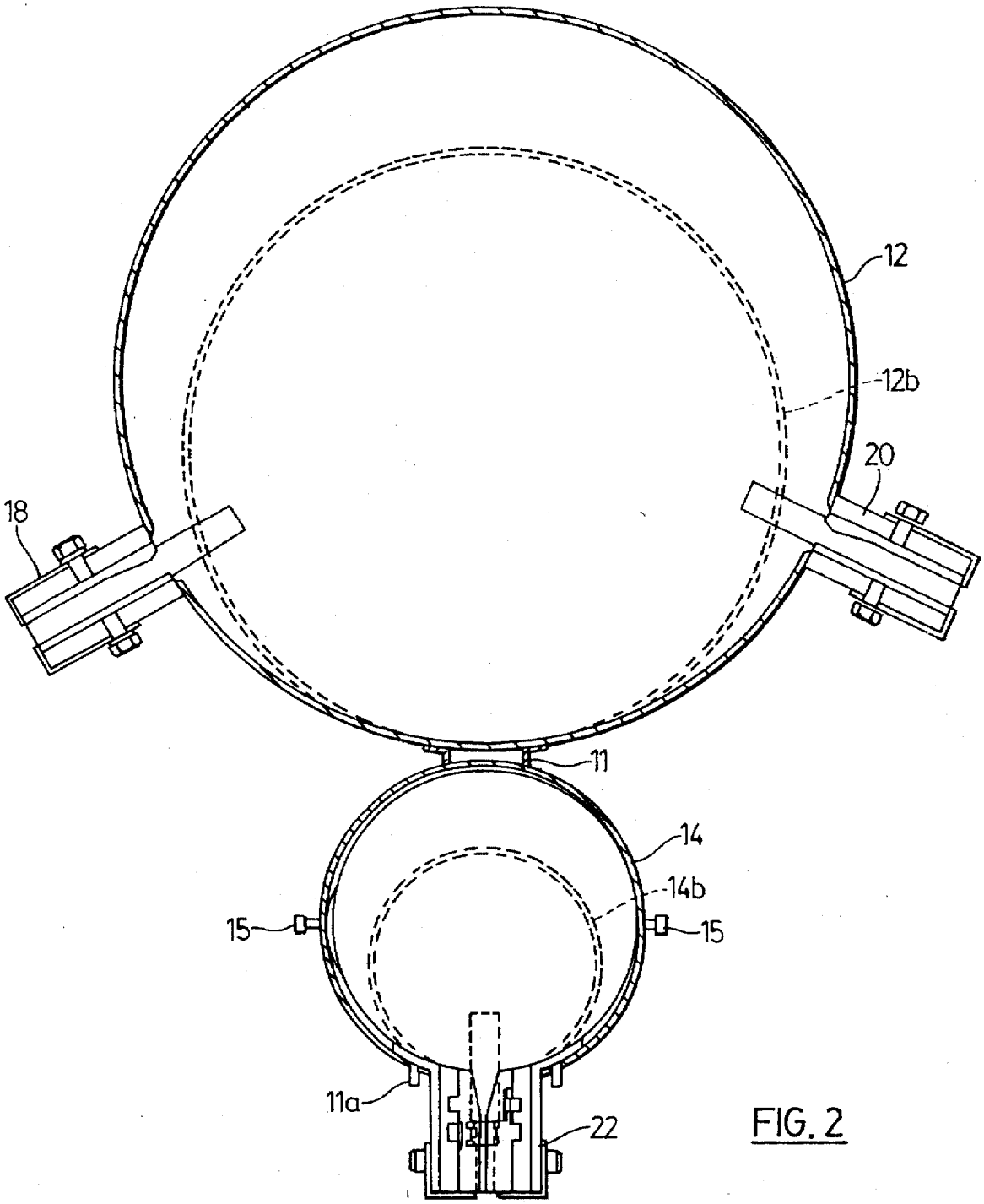
FIG. 2 shows a cross-section through the duct assembly of the apparatus along line 2—2 of FIG. 1, including a spray duct and two air distribution ducts.

Referring first to FIGS. 1 and 2, there is shown an overall view of a spraying apparatus 10 in accordance with the present invention. This spraying apparatus 10 includes a first elongate duct 14 for material to be sprayed and a second air duct 12 mounted above this. The ducts 12, 14 are secured together by brackets 11 welded to the air duct 12. These brackets 11 include tabs 11*a* to facilitate insertion of the duct 14. Clamps 15 are provided on either side of each bracket 11 to secure the duct 14 in position.

This configuration of duct is intended to extend over a length of 100 feet. It would be provided with inlets for both air and the material to be sprayed at the centre thereof, with the second duct 12 having an air inlet 16. For the first duct 14 an inlet 17 is provided and, as shown schematically at 17*a*, this includes means for introducing a material to be sprayed into the air flow. In known manner, the cross-sections of the ducts 12, 14 are reduced along the length of the overall apparatus 10, from the middle to the end thereof. Thus, as shown in FIG. 1 the air duct 12 has a central-section 12*a* of relatively large diameter, here 10 inches, and two outer end portions 12*b* of a smaller 8 inch diameter. Similarly, the duct 14 includes a central section 14*a* of 4 inch diameter and outer end portions 14*b* of 3 inch diameter. The brackets 11 are sized accordingly for the different diameters.

As shown, the outer portions 12*b* are aligned so that their bottom surfaces are continuous with the bottom surface of the central portion 12*a*. Similarly, the outer portions 14*b* also have their bottom surface continuous with the bottom surface of the central portion 14*a*, for reasons detailed below. The ducts 12 and 14 are intended in use to travel in a direction generally perpendicular their axes In accordance with the present invention, the air duct 12 is provided with a front air distribution outlet 18 and a rear air distribution outlet 20. The duct 14 is provided with a sprayer outlet 22. The configuration of the sprayer outlet 22 is described first, primarily in relation to FIGS. 4 and 5, but it will be appreciated that many elements of this outlet 22 are common with the air distribution outlets 18, 20.

The outlet 22 comprises a pair of mounting members 24, 25, which are generally symmetrical about a vertical plane indicated at 26. Many elements of the outlet 22 including the actual outlet duct itself are symmetrical about this plane 26. Each of the mounting members 24, 25 comprises a mounting portion 28, curved to conform to the outside of the duct 14 and welded to the duct 14, and a leg 30 extending outwardly from the duct 14. It can be noted that the mounting portions 28 will be given an appropriate profile for the different portions 14*a*, 14*b* of different diameters. The leg portions include holes 32 spaced at regular intervals along the length of them. Screws 110 secure angle brackets 108, to define a channel into which the other elements are inserted by sliding.

Immediately inside the mounting members 24, 25 there are left and right cell seats 34, and 35, which again are symmetrical about the central plane 26.

Each of the cell seats 34, 35 has planar outer and inner faces 36, 38 respectively. At the top, each seat 34, 35 has a concave top surface 40, conforming to the inner profile of the duct 14*a*, 14*b* as the case may be. The bottom of the cell seats 34, 35 are provided with a series of threaded, blind bores 41, to facilitate removal and insertion of these elements by sliding. Cell seats 34, 35 and other elements are provided in sections approximately 2 feet long, and are described in relation to one such section.

The seats 34, 35 serve to locate and mount inlet and outlet members. On the left hand side there is an inlet member 42, and facing this a corresponding right hand inlet 43. Below the inlet members 42, 43 there are a left hand outlet member 44 and a right hand outlet member 45. Left and right hand throat elements 46, 47 are mounted on the outlet members 44, 45 adjacent the inlet members 42, 43. The configuration is different between the two sides of the outlet, and accordingly the two sides are described in turn, with reference to FIG. 4.

On the left hand side, the left hand inlet member 42 (FIG. 4*a*) has an inner face 50, which defines a converging, inlet portion of the duct. It's outer face 51 is planar and includes an elongate rectangular rejection 52. It's upper end surface 54 again conforms to the internal diameter of the duct 14. At its lower end, it includes a main lower end surface 90 and an elongate tab 58. Tab 58 is provided with a series of three apertures 60.

The left hand outlet member 44 (FIG. 4*b*) defines a seat 62, detailed below, for the throat element 46, and has an inner face 64 defining an outlet portion of the duct. It has an outer face 66 that abuts the cell seat 34, and includes a stepped portion 68 that overlaps the elongate tab 58. Extending from the step portion 68, are three lugs 70, each of which extends through an appropriate aperture 60. The cell seat 34 is provided with two elongate rectangular grooves 71, 72, which receive, respectively, the elongate rectangular projection 52 and the lugs 70.

The right hand inlet and outlet members 43, 45 will now be described. Where similar surfaces or components are present, they are given the same reference numeral for conformity and simplicity. Thus, the right hand inlet member 43 (FIG. 4*c*) has an inner face 50 and an upper end surface 54. It has an outer surface 74, including a stepped portion 76.

The right hand outlet member 45 (FIG. 4*d*) has an inner face 64 and a seat 62. However, it has an outer face 78, which is longer than the other side, and includes an elongate rectangular projection 80. The outer face 80 continues up to an upper elongate tab 82, which includes three apertures 84. Corresponding to the apertures 84, the inlet member 43 is provided with a series of three lugs 86. As for the left hand side, the lugs 86 extend through the apertures 84 and into an elongate groove 71 of the right hand seat 35. Seat 35 has a corresponding groove 72 into which the elongate projection 80 extends.

Figure 4E:
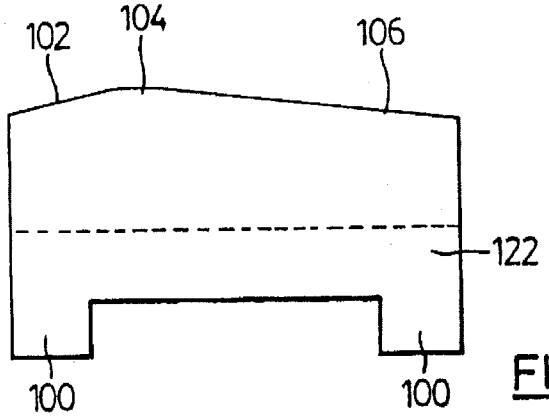
FIG. 4 is a perspective, exploded view of the distribution section of FIG. 3.
Figure 4:
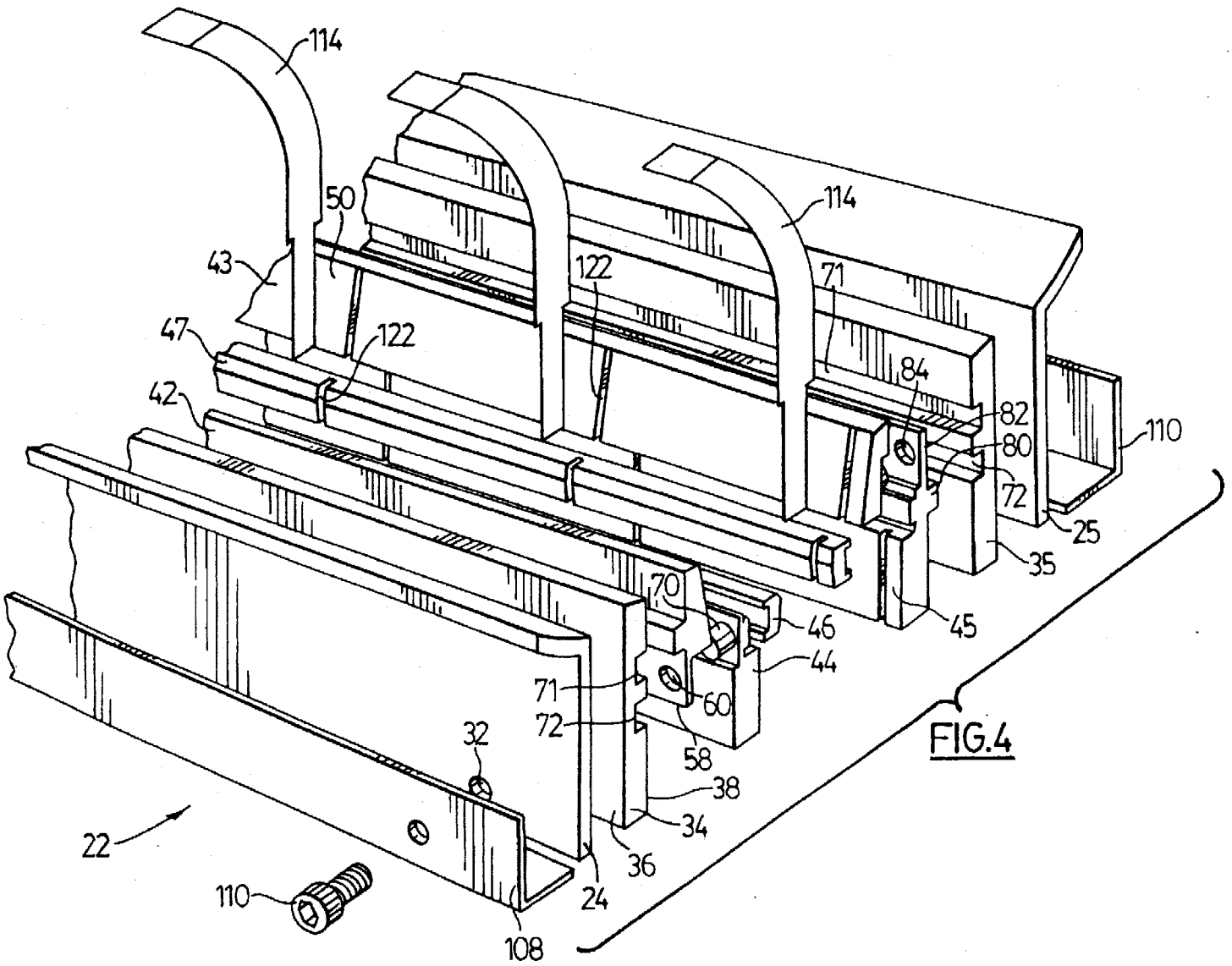
Figure 4A:
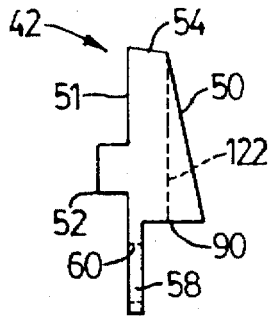
Figure 4C:
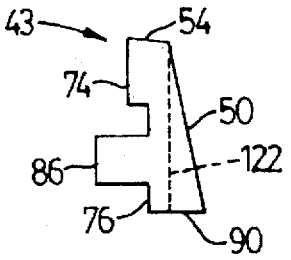
Figure 4B:
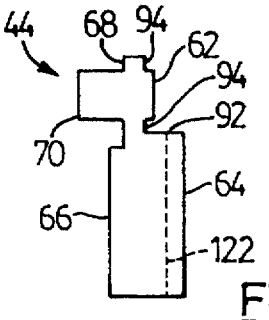
Figure 4D:
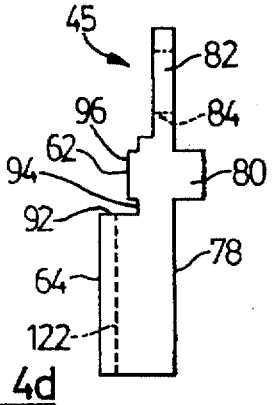

On both the left and right hand sides, the seat 62 is defined for a throat element 46 or 47, as shown in FIG. 4. This seat comprises an end wall 90 of the respective member inlet 42, or 43 and facing this is an end wall 92 of the respective outlet member 44 or 45. At the bottom of the seat 62, there are two channels 94 adjacent to the end walls 90, 92 and a raised central portion 96.

As shown in FIGS. 4 and **4*e*, the throat elements 46, 47 have symmetrical profiles. The base of each throat element corresponds to the profile of the seat and includes two elongate rectangular projections, for engaging the channels 94. The inner face of each element 46, 47 comprises a convergent inlet face portion 102, a central face portion 104 and a divergent outlet face portion 106. In known manner, the outlet face portions 106 diverge at an angle of 6° to the central plane 26**, so as to diffuse the outflow, without creating excessive turbulence.

Within the centre of the sprayer outlet 22, there is a row of fins 114. Each fin 114 includes a vertical leg 116, which comprises a lower leg portion **116*a* and an upper leg portion 116*b*. The lower leg portion 116*a* is of reduced width as shown in FIG. 9 and is received in slots 122, indicated by dotted lines in FIGS. 4 and 5, in the outlet members 44, 45 and the throat elements 46, 47. The upper leg portion 116*b* is of greater width and continues into an arcuate portion 118, which in turn continues into a straight, tapered entrance portion 120**. The upper leg portion increase in height from fin to fin.

Turning now to details of the air distribution outlets 18, 20, these are shown in detail in FIGS. 6 and 7 These are broadly similar, although FIGS. 6 and 7 show location of the throat at different positions. The overall configuration is similar to that for the sprayer outlet 22.

Each outlet 18, 20 has a pair of seats 132, 133 which provide mounting members which are welded to the air duct 12. A pair of L-shaped brackets 134 are secured by bolts 136 to the seats 132, 133, for supporting internal elements of the outlet.

On the left hand side, the seat 132 has mounted to it a left hand inlet member 138. This inlet member 138 has a convergent inlet face 140, a central face 142 and a divergent outlet face portion 144. The central face portion 142 is parallel to a central plane 146.

Below the inlet member 138, there is a left hand outlet member 148, which has a face parallel to the plane 146, the inlet and outlet members 138, 148 being formed as a single member. On the right hand side, there is a right hand member 150 which has a planar face 152 defining both inlet and outlet portions of the nozzle. As for the sprayer outlet 22, there are a series of fins 114 having a similar profile to that of the sprayer outlet 22.

As shown in FIG. 6, the inlet member can be provided adjacent the inlet of the nozzle. It may alternatively be provided midway within the nozzle or at the discharge or at the outlet port, on the right hand side, as indicated in FIG. 7. When located at the outlet port, the face must be inclined at no more than 6°, both to ensure good diffusion and also to stop skewing of the air distribution.

This later location of the discharge is preferred for extreme cold conditions, to eliminate, or reduce, freeze up of the nozzle. As the air flow is accelerated through the throat of the nozzle, its temperature dropped, and there is a tendency for ice to form. By providing this at the outlet, this phenomenon is reduced, and any ice tends to be expelled, before it can deposit within the nozzle.

Concerning dimensions, for the sprayer outlet 22, the inlet members 42 and 43 both have faces inclined at 12° to the central plane 26, as are the convergent inlet face portions 102. The dimensions of the central face portions 104 of throat elements 46, 47 vary to vary the dimension of the throat along the length of the outlet 22. Each throat element 46 has an overall height of 0.1875-inches at one end, which decreases to 0.1863-inches at the other end, over a length of 23.875". This taper continues along the full length of the device for the full 50 feet. This results in the length of the central face portions 104 increasing from 0.03 inches to 0.0471 inches over a 23.875 inch section. The divergent outlet face 106 diverges at an angle of 6° to cause smooth diffusion of the flow. The outlet members 44, 45 define faces that are parallel to the plane 26. The overall width of the sprayer outlet, on the outside including the mounting members 24,25, is 1.455 inches. Its throat has a width that commences at 0.01, 0.02, 0.03, 0.04, 0.06 or 0.06 inches depending upon factors such as intended application. A larger throat width gives larger throw or effective distance for the air flow, which in turn enables better or more accurate deposition of material from the top, to midway and to the bottom of plants. The inlet has a maximum width of 0.375" and the outlet portion has a width of 0.08".

Considering the air distribution outlets 18, 20 the inlet member 138 is similar to the throat elements of the sprayer outlet. It has a convergent face 140 that is inclined at 12° and a divergent outlet face that is here angled as 6.0°. It again has a parallel central face portion 142, which is arranged to provide a divergent effect for the nozzle.

Each outlet has an overall width of 1.0 inches and a height of 2.0". The throat can have a minimum width of 0.1875 inches with both the inlet and the outlet having a width of 0.25 inches. Depending upon the application, strength of air curtain required, available blower power and the like, the width of the throat can be increased. For example, the throat could have an initial width of 4 inches, with the inlet and outlet dimensions increased accordingly. In all cases, the width of the throat increases at 0.0001 inches per inch of length.

As mentioned above, the upper leg portion **116*b*** of each fin increases in height away from the inlet. The rate at which this height increases, i.e. the fin ramping rate, can vary in the range of 0.0008 inches to 0.01 inches for every inch away from the inlet. The overall height of the fins, that is the height of the fins, in the radial direction of the ducts, which extend externally into the duct, can vary as in the following table:

| DUCT SIZE | FIN EXTENT INTO DUCT |
|---|---|
| 1" diameter | 0.1250 to 0.2500" |
| 2" diameter | 0.2500 to 0.3750" |
| 3" diameter | 0.3750 to 0.7500 |
| 4" diameter | 0.5000 to 1.00" |
| 5" diameter | 1" to 1.1250" |
| 6 to 12" diameter | 1.1250" to 2.5" |

These figures apply to both the air distribution duct and the spraying duct, since essentially the same issue arises of ensuring even distribution of the air along the nozzle. It has been found that best performance is obtained if there is some regular increase in fin height along the length of the duct.

The distance between the fins can be constant for individual lengths of the duct and there may be uniform fins spacing along the whole length of the apparatus. Typically, the distance between adjacent pairs of fins can vary in the range of 1.5 to 3 inches.

It is possible that the fins can be moulded integrally with an inlet element as indicated in FIG. 8, with the opposite inlet element simply being with the slots to receive the fins. The disadvantage with molding in a plastic material is that it is difficult to obtain tolerances than 0.001 inches. Presently, it is preferred to form the fins individually from sheet steel and to provide each fin with some form of indentation or protrusion, so that they will form an interference fit in a slot in the inlet/outlet members.

Turning now to FIGS. 11 and 12, these show details of end distribution outlets 150, provided at either end of the air duct 12. The smaller outer portions **12*b* of the duct 12 terminate in flanges 152, provided with a series of spaced bolt holes 154. An end plate 156, with corresponding holes 157, is bolted to this flange 152 and spaced from it by a spacer 158**.

The spacer 158 extends through 240° to leave an arc of 120° unobstructed. This arc at the bottom of the forms an end nozzle divided into 5 adjacent nozzle portions. For this purpose, the end plate 156 includes 5 radial extensions 160 separated by slots 162. Complementary to the radial extensions 160 there is an end frame element 164, including a series of threaded studs 166. These are threaded externally to receive nuts to secure the assembly to the flange 152. The end frame element 164 has a profile similar to the radial extensions 160. The spacer 158 ensures that there is a space between the end frame element 164 and the extensions 160, with a width equal to the thickness of the spacer 158. In this space, there is a flow divider or nozzle defining element 168, which is pressed from sheet steel. As for the other nozzle outlets, it has a convergent inlet face 170, a throat 171 and a divergent outlet face 172. The nozzle element defines one side of the nozzle or slot and the other side is defined by a fin assembly 174.

The fin assembly 174 defines five fin segments 176, which are formed from a single piece of sheet steel. As for the end cap, slots 178 are provided. The radially inner ends of the fins 176, indicated at 180 are curved inwards by approximately 90° to direct air flow down into the slots or nozzles.

Individual slots or nozzles are separated by separate nozzle dividers 182. It will be appreciated that five individual nozzles are formed by the end distribution outlet 150. Each nozzle is defined on one side by the nozzle defining element 168 and on the other side by a respective fin 176. The profile of the nozzle defining element 168 and in particular the width of the nozzle at the throat 171 is chosen to give the desired flow characteristics. Here, the two outer nozzles are given a throat width of 0.60", while the three central nozzles are given a width of 0.04", to ensure that there is adequate flow at the corners where these end nozzles join the main elongate nozzles and where the greatest throw is required.

The arcuate extent of the nozzles provided by the end distribution outlet 150 can be chosen depending upon the intended application and the orientation of the air distribution outlets 18, 20. Ideally, the end distribution outlet 150 is substantially continuous with the outlet 18, 20, so as to form a continuous air curtain around the sprayer outlet 22.

Turning back to FIG. 2, this shows the overall relative position of the air distribution outlets 8 and 20 with respect to the sprayer outlet 22. The relative angles and orientations of these different outlets can be varied for different purposes. Thus, as indicated, each of the air distribution outlets 18, 20 can be at an angle between 25° to 90° from the horizontal. The following angle ranges are preferred for different applications: 25°–35° for use on a pull-type unit with a boom height of 20–30 inches; 45°–55° for a self-propelled sprayer unit with a boom height of 30–48 inches; 65°–75° for use row crop applications, turf, lawn and golf course applications, and other special applications, with a boom height of 20–48 inches.

The angle of the spray outlet nozzle 22 can be varied between 25°–90° relative to the horizontal. This angle should be chosen such that there is always at least a 10° difference in angle between it and each of the air distribution outlets 18, 20, to keep the spray within the two air curtains.

The spray outlet 22 can be used to dispense chemicals, for applications to crops and the like, which are either in liquid or solid form. Liquid materials can be atomized or sprayed into the air stream as an aerosol, in the desired concentration, so that they are carried along the duct 14. This eliminates problems of using water as a carrying agent and reduces the volume and weight of material that has to be carried. Other chemicals and materials in fine particulate or powder form can also be handled similarly, by simply discharging them into the air flow so that a uniform distribution of the powder is formed in the air, and it is carried along with the air flow. Clearly, where a solid or powder material is used, the minimum dimension of the throat of the nozzle should be chosen to ensure that no blocking can occur.

While the preferred embodiment of the invention includes an elongate duct for spraying chemicals, which includes an elongate slot-shaped nozzle, other means of spraying chemicals and the like can be provided. In other words, a key aspect of the invention is the provision of the air curtains provided by the air distribution outlets 18, 20, which can be used with any suitable spraying equipment. For example, discrete spray jets can be used, spaced at regular intervals along a supply duct similar to the duct 14. Although it is suggested that the material to be sprayed could be dispersed as an aerosol or the like within an airflow, equally conventional spraying equipment can be provided. The chemical and material to be sprayed can be provided as a solution in water or other solvent, which is then sprayed from discrete nozzles or by any suitable means.

Tests with apparatus in accordance with the present invention have established that it can successfully reduce or totally eliminate disturbance by ambient air curtains. In particular, the air curtains produced from the air distribution outlets have the effect of de-energizing ambient air, to create a zone of still air around the sprayer outlet 22. The effect of this is to establish a "zero drift" zone for the sprayer outlet, permitting much more efficient application of the chemical material to be disbursed. Knowing that the chemical, or material will be dispensed, will be distributed evenly and efficiently, smaller quantities of the material can be used; customarily, excess quantifies are applied, to allow for drift, dispersion, loss, etc. The following table is exemplary of the air flow and power requirements needed for different conditions. As might be expected, for high relative wind velocities, and high elevations, the air flow and power requirements are both significant. Nonetheless, one would not usually choose to spray in the strong wind conditions. Even where a crop requires high elevation, provided moderate wind conditions are available, the overall power requirement and air flow requirement are not excessive, and can readily be provided.

| Relative Wind Velocity | Air Flow and Horsepower for Various ADS Elevation Above Crop | | | | |
|---|---|---|---|---|---|
| (mph) | 5" | 10" | 15" | 20" | 25" |
| 5 | | | | | |
| CFM | 2,750 | 3,094 | 3,536 | 4,124 | 4,950 |
| HP | .3 | .4 | .7 | 1.1 | 1.8 |
| 10 | | | | | |
| CFM | 5,500 | 6,188 | 7,070 | 8,250 | 9,900 |
| BHP | 2.5 | 3.6 | 5.3 | 8.6 | 14.6 |
| 15 | | | | | |
| CFM | 8,250 | 9,280 | 10,606 | 12,374 | 14,850 |
| BHP | 6.7 | 15.7 | 18.0 | 28.6 | 49.3 |
| 20 | | | | | |
| CFM | 11,000 | 12,374 | 14,142 | 16,498 | 19,798 |
| BHP | 20.0 | 28.6 | 42.6 | 67.7 | 117.0 |
| 25 | | | | | |
| CFM | 13,750 | 15,468 | 17,678 | 20,624 | 24,748 |
| BHP | 38.9 | 55.8 | 83.3 | 132.2 | 228.4 |
| 30 | | | | | |
| CFM | 16,498 | 18,562 | 21,212 | 24,748 | 29,698 |
| BHP | 67.7 | 96.4 | 143.8 | 228.4 | 394.7 |

The above table shows tests carried out with two nozzles on a boom of 100 feet width. The nozzles each had a width of 1/16th inch, for a total slot area of 150 in$^2$. The air distribution nozzles had a slope of 30°. The blower had an assumed efficiency of 60%. The air flow is given in cubic feet per minute (cfm), and the required power is given in brake horsepower. It can be seen that even for high elevations, only a moderate amount of power is required, if excessively strong wind conditions are avoided.

I claim:

1. An apparatus for distributing a particulate material over a surface, the apparatus comprising:

a first elongate duct means for delivery of material to be distributed, including an inlet for the particulate material, the duct being intended for movement in a direction generally perpendicularly thereto;

distribution means for distributing the particulate material, the distribution means extending along the first elongate duct means and being connected to the first elongate duct means whereby, in use, the distribution means can be maintained at a generally constant spacing from the surface; and air curtain means extending along the first elongate duct means and including an elongate air distribution outlet, and means for supplying air to said air distribution outlet, to form an air curtain to reduce disturbance by ambient air currents of material distributed by the distribution means, wherein said elongate air distribution outlet is positioned relative to the distribution means, such that there is substantially no interaction between the air curtain and particulate material distributed from the distribution means.

2. An apparatus as claimed in claim 1, wherein the air curtain means comprises a first elongate air distribution outlet in front of the first elongate duct means and a second elongate air distribution outlet behind the first elongate duct means, for generating a second air curtain both of which first and second elongate duct means are positioned such that there is substantially no interaction between the air curtain and distributed particulate material.

3. An apparatus as claimed in claim 2, wherein the air curtain means includes: a second elongate duct means for a supply of air, mounted adjacent the first elongate duct means and including an inlet for air, wherein each of the first and second air distribution outlets includes an elongate, substantially continuous slot-shaped nozzle extending therealong, which nozzles include inlet ports opening into the second elongate duct means and outlet ports directed outwardly from the first elongate duct means and towards a surface on which the material is to be dispersed.

4. An apparatus as claimed in claim 3, wherein the air curtain means includes end distribution outlets extending between ends of the first and second air distribution outlets, to form a substantially continuous air curtain around the distribution means, which forms a zone of substantially still air and which is directed such that there is substantially no interaction between the substantially continuous air curtain and the distributed particulate material.

5. An apparatus as claimed in claim 3, wherein each of the first and second air distribution outlets includes a convergent inlet section, a throat section and a diffuser section, wherein the width of the respective throat section increases in a direction away from the inlet of the second duct means.

6. An apparatus as claimed in claim 5, wherein each of the first and second air distribution outlets includes a plurality of fins spaced therealong, each of which fins includes one end directed towards the inlet of the second elongate duct means and another end directed towards the outlet port, to direct air from the second elongate duct through the elongate slot-shaped nozzle.

7. An apparatus as claimed in claim 6, wherein the fins are curved.

8. An apparatus as claimed in claim 7, wherein the fins extend through the inlet, throat and diffuser sections.

9. An apparatus as claimed in claim 6 or 8, wherein the fins extend into the second elongate duct and the height of the fins extending into the duct increases in a direction away from the inlet of the second elongate duct means.

10. An apparatus as claimed in claim 4, wherein each of the first and second air distribution outlets includes a plurality of fins spaced therealong, each fin being arranged to deflect air flow from the second elongate duct into an associated elongated slot-shaped nozzle.

11. An apparatus as claimed in claim 8, wherein the air curtain means includes end distribution outlets extending between ends of the first and second air distribution outlets, to form a continuous air curtain around the distribution means.

12. An apparatus as claimed in claim 3, wherein the distribution means comprises a distribution elongate slot-shaped nozzle, which is mounted on the first elongate duct means and extends therealong.

13. An apparatus as claimed in claim 12, wherein the distribution slot-shaped nozzle comprises an inlet section, a throat section, and a diffuser section, with the width of the throat section increasing in a direction away from the inlet of the first elongate duct means.

14. An apparatus as claimed in claim 12, wherein the distribution means includes a plurality of fins, each of which comprises a first end extending into a first elongate duct means towards the inlet thereof and a second end extending towards the outlet port of the distribution slot-shaped nozzle.

15. An apparatus as claimed in claim 14, wherein the fins are generally curved.

16. An apparatus as claimed in claim 15, wherein each fin has an inlet portion extending into the first elongate duct means and wherein the height of the inlet portions of the fins increases in a direction away from the inlet of the first elongate duct means.

17. An apparatus as claimed in claim 1, which includes at least one of: (1) the elongate distribution outlet being spaced apart from the distribution means; and (2) the elongate distribution outlet being directed at an angle away from the distribution means.

18. An apparatus as claimed in claim 2, 3 or 16, which includes at least one of: (1) the first and second elongate distribution outlets being spaced apart from the distribution means; and (2) the first and second elongate distribution outlets being directed at an angle away from the distribution means.

19. An apparatus as claimed in claim 4 or 10, wherein the second elongate duct means is substantially tubular and has planar end flange means, and wherein end plates are provided secured to the end flange means to close off the second elongate duct means and the end distribution means comprise nozzles formed between the end flange means and the end plates.

20. An air distribution outlet comprising: an elongate air duct having an inlet for air; an elongate air distribution outlet mounted on and extending along the elongate air duct and defining an elongate slot-shaped nozzle, which has an inlet port opening into the air duct and an outlet port; wherein the nozzle has extending between the inlet port and the outlet port thereof, a convergent inlet section, a throat section, and a diffuser section, and the width of the throat section increases in a direction away from the air inlet; and wherein the air distribution outlet includes a plurality of fins, each of which includes an end section extending into the elongate air duct and directed towards the air inlet, and another end section directed towards the outlet port to deflect air flow within the air duct towards the outlet port.

21. An air distribution apparatus as claimed in claim 20, wherein the fins are generally curved.

22. An air distribution apparatus as claimed in claim 21, wherein each fin extends to approximately 90°.

23. An air distribution apparatus as claimed in claim 20 or 19, wherein the fins extend through the convergent section, the throat section and the diffuser section.

24. An air distribution apparatus as claimed in claim 21, wherein the fins are evenly spaced along the length of the air distribution outlet.

25. An air distribution apparatus as claimed in claim 24, wherein, in section, the convergent, throat and diffuser sections are coaxial and the nozzle in cross-section has a common axis, and wherein the diffuser section has surfaces defining the diffuser section, which are at an angle of no more than 6° to the axis of the nozzle.

26. An air distribution apparatus as claimed in claim 25, wherein the diffuser section includes a portion of constant cross-section.

27. A method of distributing a particulate material over a surface, the method comprising the steps of:

(1) providing an elongate duct means for delivery of material to be distributed and distribution means for distributing the particulate material, the distribution means extending along the first elongate means;

(2) moving the first elongate duct means and the distribution means over the surface in a direction generally perpendicularly to the elongate duct means while maintaining the distribution means at a generally constant spacing from the surface;

(3) distributing particulate material through the distribution means onto the surface;

(4) providing an air curtain positioned relative to the distribution means so as to reduce disturbance by ambient air currents of material distributed from the distribution means and such that there is substantially no interaction between the air curtain and the distributed particulate material.

28. A method as claimed in claim 27, wherein in step (4), a first air curtain is provided in front of the elongate duct means and the distribution means, and a second air curtain is provided behind the first elongate duct means and the distribution means.

29. A method as claimed in claim 28, wherein step (4) comprises providing a substantially continuous air curtain around the distribution means.

30. A method as claimed in claim 29, wherein the air curtain is provided through a plurality of slot-shaped nozzles.

31. A method as claimed in claim 30, wherein the air is supplied to the slot-shaped nozzles from an elongate duct, and wherein the air flow is deflected from the duct into the slot-shaped nozzles by a plurality of fins.

32. A method as claimed in claim 27 or 29, wherein the air curtain is spaced away from the distribution means.

33. A method as claimed in claim 27 or 29, wherein the air curtain is directed away from the distribution means.

34. A method as claimed in claim 27 or 29, wherein the air curtain is both spaced away from and directed away from the distribution means.

* * * * *